US007238080B2

(12) United States Patent
Gimble

(10) Patent No.: US 7,238,080 B2
(45) Date of Patent: Jul. 3, 2007

(54) BRA SUPPORT CUP

(76) Inventor: Richard Gimble, Va Bien International HCO2 Box 12193 State Road 156, Aguas Buenas, PR (US) 00703

( * ) Notice: Subject to any disclaimer, the term of this patent is extended or adjusted under 35 U.S.C. 154(b) by 7 days.

(21) Appl. No.: 11/269,950

(22) Filed: Nov. 9, 2005

(65) Prior Publication Data

US 2007/0026766 A1 Feb. 1, 2007

Related U.S. Application Data

(60) Provisional application No. 60/703,701, filed on Jul. 29, 2005.

(51) Int. Cl.
*A41C 3/10* (2006.01)
*A41C 3/14* (2006.01)

(52) U.S. Cl. ..... 450/41; 450/57; 2/255; 2/267; 2/256

(58) Field of Classification Search ..... 2/255, 2/256, 258–260, 261, 267, 268; 450/39–44, 450/53

See application file for complete search history.

(56) References Cited

U.S. PATENT DOCUMENTS 204,460 A * 6/1878 Tallman ..... 450/43
267,365 A * 11/1882 Blum ..... 15/56
401,028 A * 4/1889 Greene ..... 450/43
2,039,821 A * 5/1936 McKeefrey ..... 450/41
2,891,544 A * 6/1959 London ..... 604/379
2,915,067 A * 12/1959 Bracht ..... 450/45
3,254,653 A * 6/1966 Krieger ..... 450/39
3,421,515 A * 1/1969 Schaefer ..... 450/53
4,632,118 A * 12/1986 Garutso ..... 450/53
5,480,429 A * 1/1996 Weber-Unger ..... 623/7
5,522,892 A * 6/1996 Lin ..... 623/7
6,257,951 B1 * 7/2001 DeMarco ..... 450/55
6,447,365 B1 * 9/2002 Powell et al. ..... 450/41
6,695,677 B1 * 2/2004 Lin ..... 450/41

* cited by examiner

*Primary Examiner*—Gloria M. Hale
(74) *Attorney, Agent, or Firm*—Hoglund & Pamias PSC; Roberto J. Ríos

(57) ABSTRACT

A bra support cup is made using two layers of foam. The outer layer has grooves along its inner surface. These are used to hold plastic ribs. The inner layer is bonded to the inner surface of the outer layer to hold the plastic ribs in place.

7 Claims, 6 Drawing Sheets

BRA SUPPORT CUP

FIELD OF THE INVENTION

The invention relates to bras and more specifically to support cups used in bras.

BACKGROUND OF THE INVENTION

Modern bras are designed to accommodate both a need for comfort during wear and a need for support. For larger sized breasts, these two purposes can pose design difficulties. Sturdy wired bras provide support, but can be uncomfortable when worn for a long period of time. Softer materials tend not to provide sufficient support.

SUMMARY OF THE INVENTION

A bra support cup has two interior layers of foam. The support cup is thickest toward the middle and thinnest toward its outer edges. A set of plastic strips are positioned between the two layers of foam. These plastic strips are on the bottom side of the cup to provide additional support.

According to one aspect of the invention, a bra support cup has a first and a second layer of foam and a plurality of ribs. The first layer of foam is formed in the shape of a cup. An inner surface of this layer of foam defines a plurality of grooves that extend radially out from a center of the cup. A rib is positioned in each of the grooves. The second layer of foam is formed in the shape of a cup and bonded to the inner surface of the first layer of foam so that the plurality of ribs are confined between the first layer of foam and the second layer of foam.

According to further aspects of the invention, the first layer of foam and the second layer of foam have a top edge cut along an arc curving downward about a first center and a bottom edge cut along an edge curving upward about a second center. The first center lies below the second center so that the top edge meets the bottom edge to form a point on a leftmost and rightmost side of the cup. The plurality of grooves comprise a middle groove that extends vertically down from proximate the center of the first layer of foam, a left groove and a right groove each of which extend down at an approximately 45 degree angle with respect to the middle groove. The plurality of ribs are made of plastic and each have a first end and a second end. The first end has a rectangular cross section of uniform thickness and the second end has a rectangular cross section of uniform thickness which is thinner than the first end and which joins the first end at a sloped step. The second end is rounded. The first layer of foam and the second layer of foam are made of polyurethane. The first layer of foam is thickest near the center of the cup and thinnest near the top edge and the bottom edge. The second layer of foam has a uniform thickness that is thinner than the first layer of foam.

DETAILED DESCRIPTION

Figure 1:
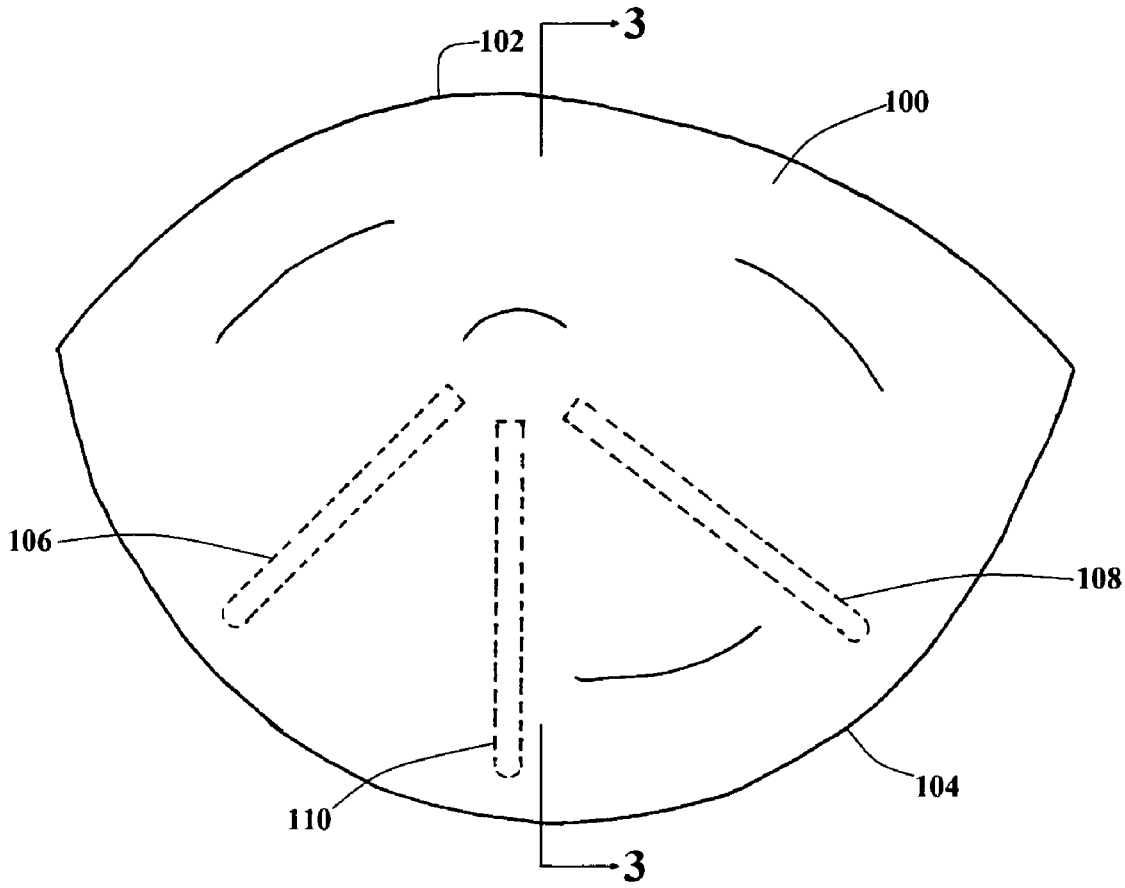
FIG. 1 is a front view of a bra support cup.

Turning to FIG. 1, a bra support cup 100 has an upper lip 102 and a lower lip 104. The upper lip 102 is cut along an arc curving downward. The arc is substantially circular so that the curve has a uniform, radial distance from a point. The lower lip 104 is cut along an arc curving upward and which joints the upper lip 102. This arc is also substantially circular so that the curve has a uniform, radial distance from a point. The point about which the upper arc curves is below the point about which the lower arc curves so that the two arcs meet at a point on each side of the cup. The support cup 100 is convex so that it curves outward between the upper lip 102 and the lower lip 104.

A set of plastic strips or ribs 106, 108 and 110 are embedded within the support cup 100. These provide additional support. Plastic strip 110 is approximately centered and set at a vertical orientation when viewed from the front. Plastic strip 106 is positioned off-center to the left. It is set at an upward-slanted orientation when viewed from the front. Plastic strip 108 is positioned off-center to the left. It is set at a downward-slanted orientation when viewed from the front. The plastic strips 106 and 108 lie at an approximately 45 degree angle with respect to plastic strip 110. They radiate from a common point proximate the center of the support cup 100.

Figure 2:
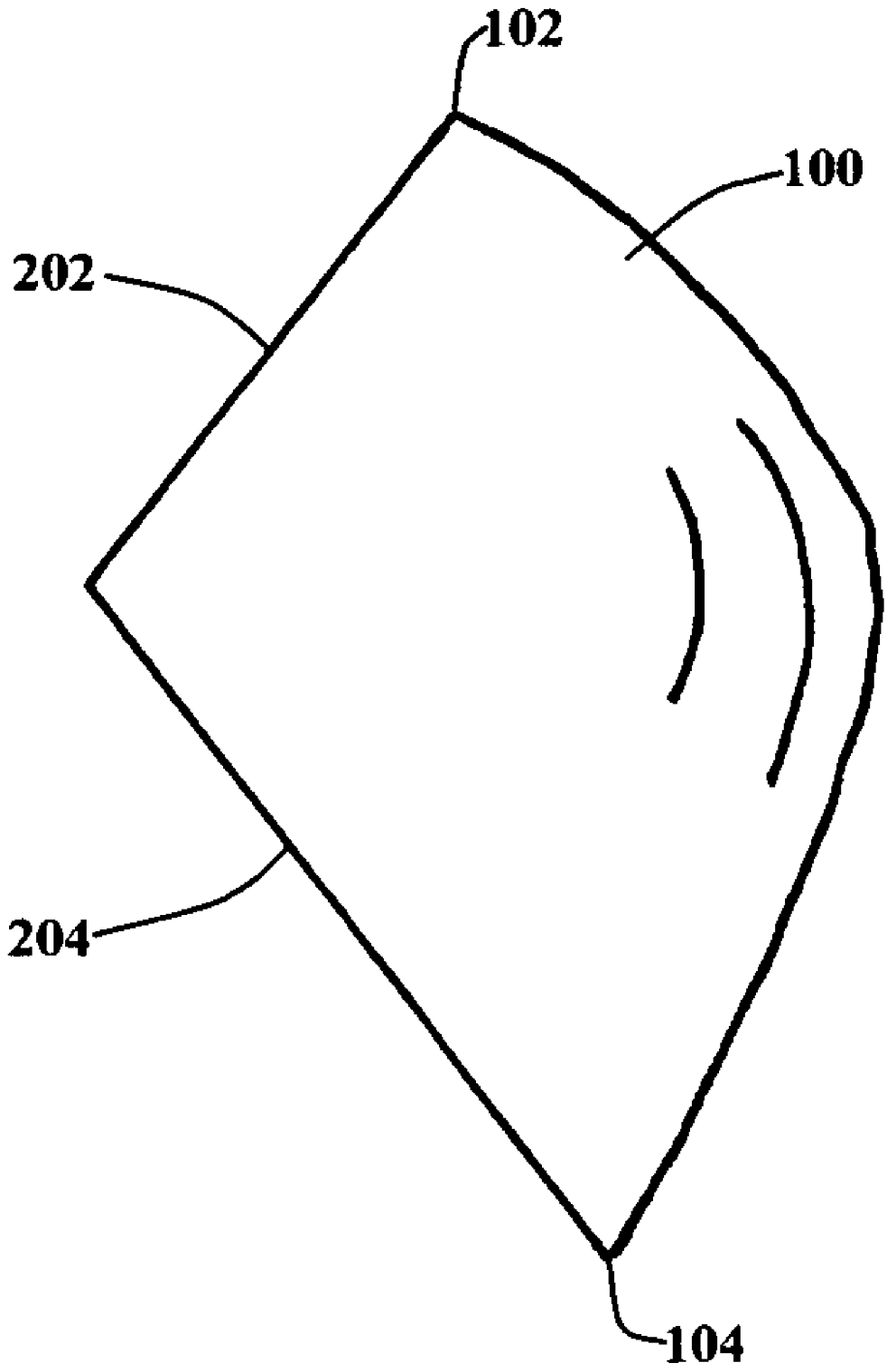
FIG. 2 is a side view of the bra support cup of FIG. 1.

Turning to FIG. 2, a side view of the support cup 100 is shown. The upper lip 102 forms a substantially straight edge 202 from this perspective. The lower lip 104 also forms a substantially straight edge 204 from this perspective.

Figure 3:
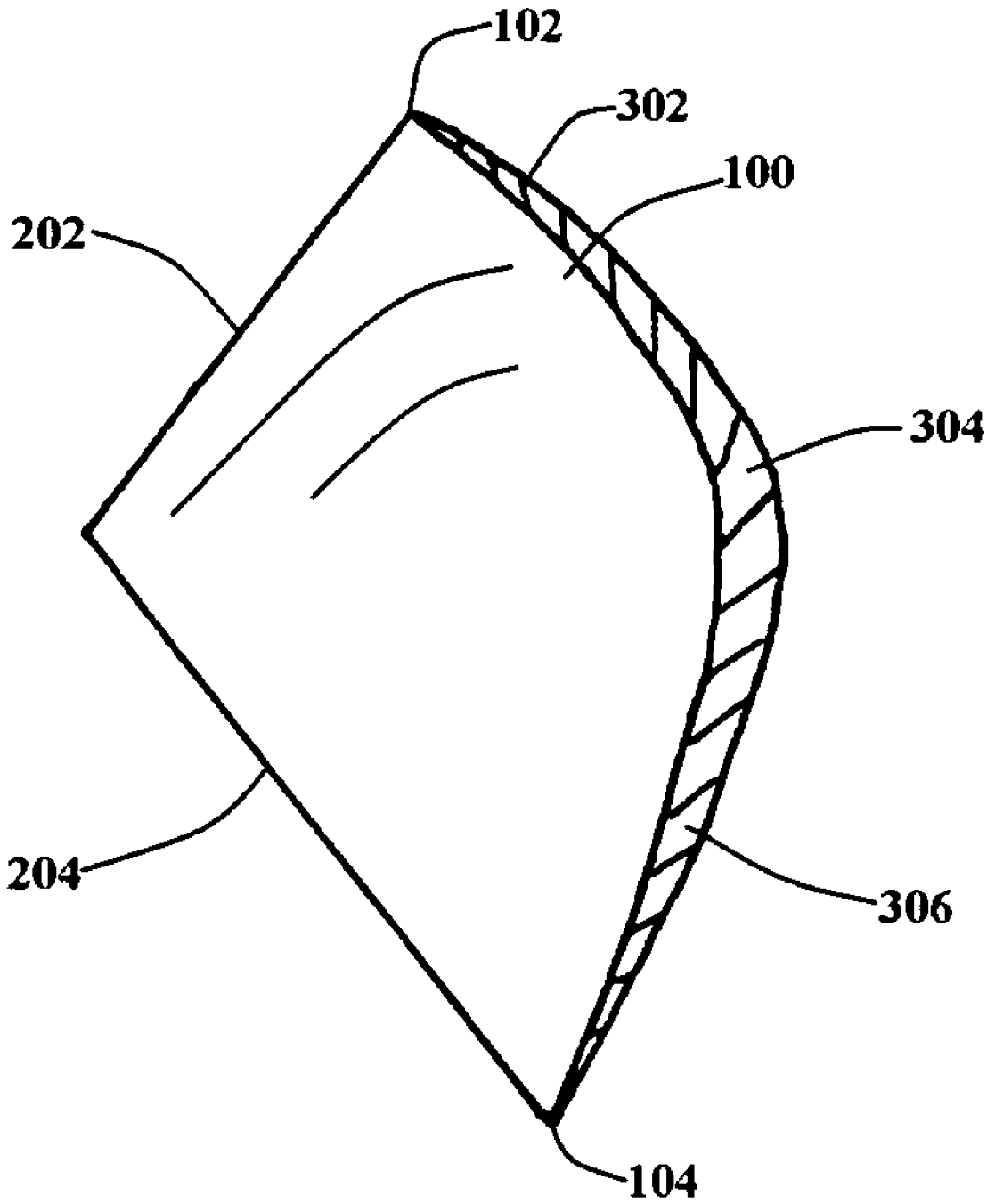
FIG. 3 is a cross sectional view of the bra support cup of FIG. 1 take from the perspective shown as 3-3 in FIG. 1.

Turning to FIG. 3, a cross sectional view of the support cup 100 is shown. The support cup has a foam filling consisting of a top portion 302, a middle portion 304 and a lower portion 306. The middle portion 304 is the thickest. The top portion 302 is the thinnest as it ends at upper lip 102 and gradually widens as it becomes middle portion 304. The bottom portion 306 is thinnest at the lower lip 104 and gradually widens as it becomes middle portion 306.

Figure 4A:
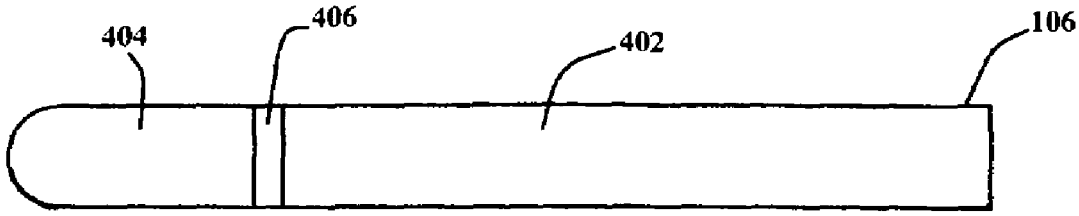
FIGS. 4A and 4B are, respectively, a top and a side view of a plastic support strip used in the bra support cup of FIG. 1.
Figure 4B:
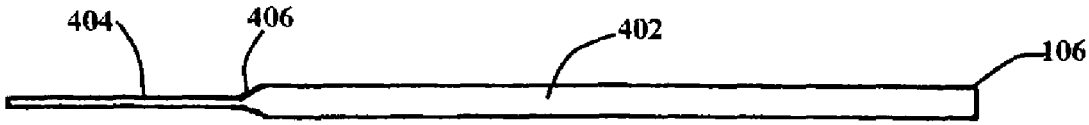

Turning to FIGS. 4A and 4B, the plastic strips 106, 108 and 110 are further described. They have the same design. Consequently, only plastic strip 106 is shown in FIGS. 4A and 4B. The plastic strip 106 consists of three parts, a main body 402, a sloped step 406 and a flexible strip 404. A main body 402 has a rectangular cross section with a wide top face (shown in FIG. 4A) and a narrower side wall (shown in FIG. 4B). The main body 402 extends along most of the length of the plastic strip 106. It provides the support in the cup. The main body 402 meets a step 406. The step 406 is sloped and leads to the narrower, flexible strip 404. It is rounded at its end. When positioned in the cup 100, this is the rounded end is at the bottom. Because it is narrower, it is also more flexible.

Figure 5:
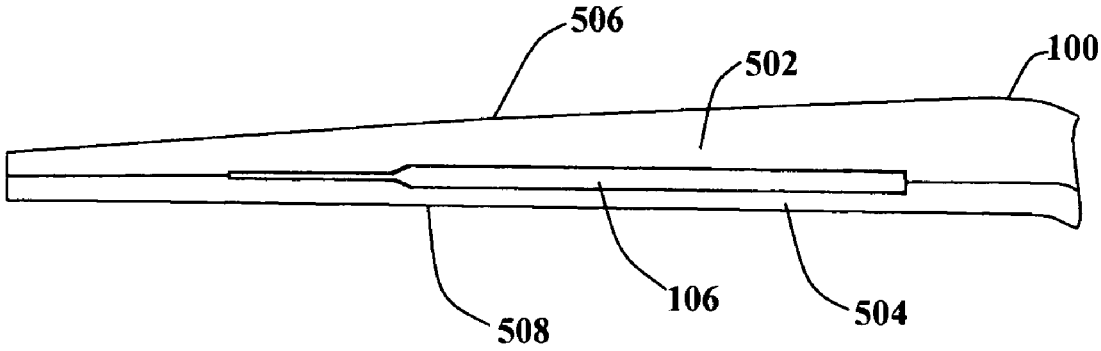
FIG. 5 is a cross-sectional view of the bra support cup of FIG. 1 showing the position of a plastic support strip.

Turning to FIG. 5, the plastic strip 106 is shown positioned within the support cup 100. The support cup 100 consists of four layers, in addition to the plastic strips. An outer layer 506 and an inner layer 504 are polyester fabric. A pair of foam layers 502 and 504 are sandwiched between the outer layer 506 and the inner layer 504. The foam is preferably polyurethane or any other foam providing flexible support. The inner layer of foam 504 is of substantially uniform thickness. The outer layer of foam 504 is thinnest at the outside edges and thickens toward the middle of the cup 100. This additional thickness helps to hide the plastic strips. In addition, during formation of the outer layer of foam, grooves are formed to accommodate the plastic ribs. These grooves are made in the same position as the ribs as shown in FIG. 1.

Figure 6:
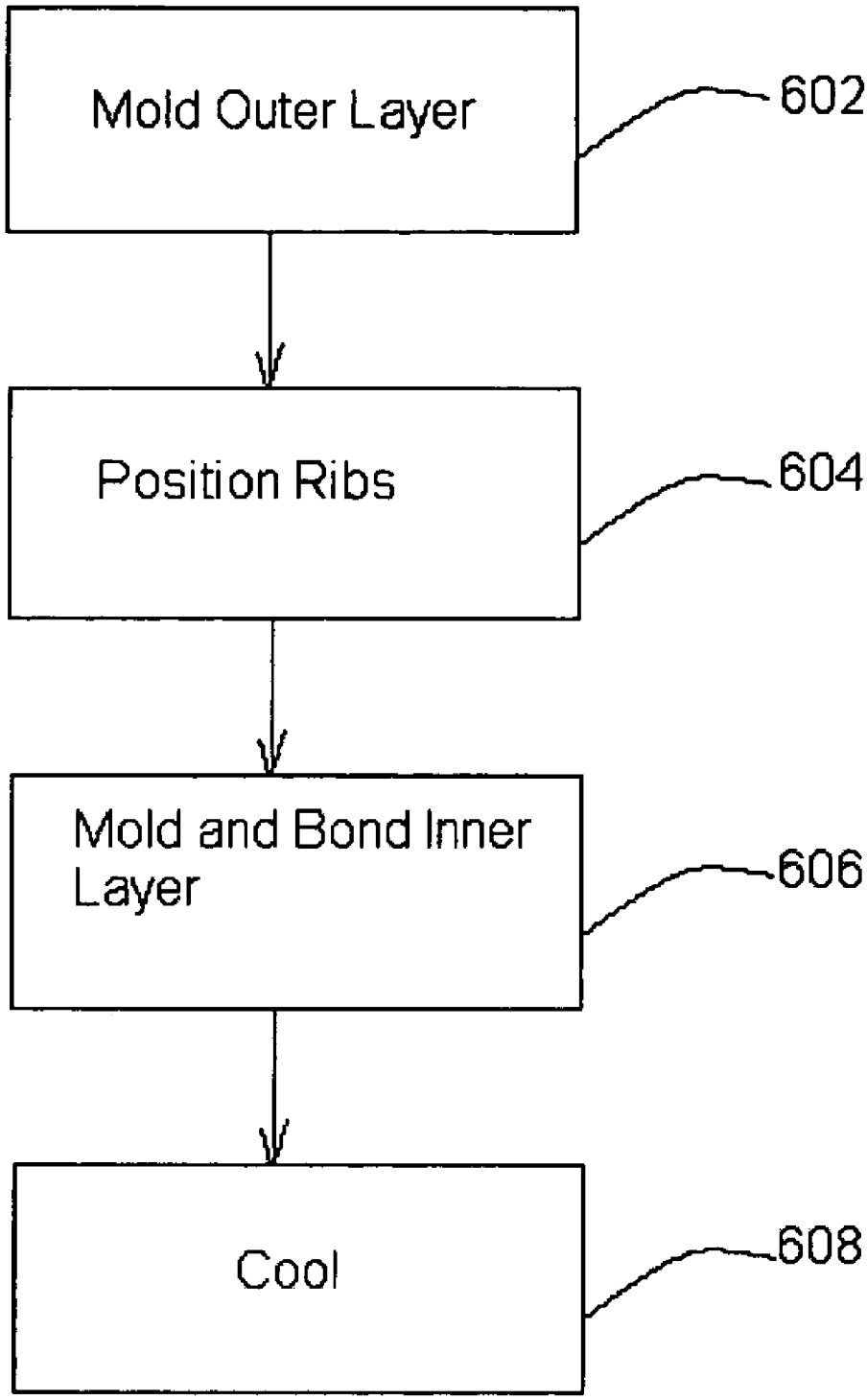
FIG. 6 is a flow chart showing steps used in the manufacture of the bra support cup of FIG. 1.

The process of making a bra support cup is described with reference to FIG. 6. First, at step 602 a layer of polyurethane foam is molded into the shape of a bra cup. This is the outer layer of the bra cup. The mold used to form the cup includes ribs that form grooves or depressions in the inner surface of the cup where the plastic ribs or stays are later placed. The cup is formed at approximately 200° C. and takes approximately two minutes and thirty seconds.

Next, at step 604, the plastic stays or ribs are placed in the grooves in the outer layer of the support cup. Then, at step 606, another layer of foam is placed inside the first layer, which is housing the plastic stays. A mold is pressed against the inner layer to form the cup shape. The bottom mold, which presses against the bottom layer, is set at approximately 200° C. and the top of the mold, which presses against the top layer, is set at approximately 190° C. This process fuses the top and bottom layer together. Finally, at step 608, the cup is cooled for at least eight minutes.

Although the invention has been described with reference to a specific preferred embodiment, those skilled in the art will appreciate that many modifications and variations can be made without departing from the spirit and scope of the invention. All such modifications and variations are intended to be encompassed within the scope of the following claims.

I claim:

1. A bra support cup comprising:

a first layer of foam formed in the shape of a cup, wherein an inner surface of the first layer of foam defines a plurality of grooves molded into the inner surface;

a plurality of ribs each positioned in a respective one of the plurality of grooves in the first layer of foam, wherein the plurality of ribs are made of plastic and wherein each of the plurality of ribs have a first end a second end, wherein the first end is thicker than the second end, and wherein the second end is rounded; and a second layer of foam formed in the shape of a cup and bonded to the inner surface of the first layer of foam so that the plurality of ribs are confined between the first layer of foam and the second layer of foam.

2. The bra support cup of claim 1, wherein the first end has a rectangular cross section of uniform thickness and the second end has a rectangular cross section of uniform thickness and wherein the first end joins the second end at a sloped step.

3. The bra support cup of claim 1, wherein the first layer of foam and the second layer of foam are made of polyurethane.

4. The bra support cup of claim 3, wherein the first layer of foam is thinnest near the outer edge wherein the cup is bounded by an outer edge and.

5. A bra cup support comprising:

a first layer of polyurethane foam formed in the shape of a cup, wherein an inner surface of the first layer of foam defines a plurality of grooves molded into the inner surface and wherein the cup is bounded by an outer edge and wherein the first layer of foam is thinnest near the outer edge;

a plurality of ribs each positioned in a respective one of the plurality of grooves in the first layer of foam; and a second layer of polyurethane foam formed in the shape of a cup and bonded to the inner surface of the first layer of polyurethane foam so that the plurality of ribs are confined between the first layer of polyurethane foam and the second layer of polyurethane foam, wherein the second layer of foam has a uniform thickness that is thinner than the first layer of foam.

6. The bra support cup of claim 1, wherein an outside surface of the first layer of foam and an inside surface of the second layer of foam are each covered with a layer of material.

7. The bra support cup of claim 1, wherein:

the first layer of foam and the second layer of foam

* * * * *